US006336618B1

(12) United States Patent
Barber

(10) Patent No.: US 6,336,618 B1
(45) Date of Patent: Jan. 8, 2002

(54) ADJUSTABLE COMPUTER KEYBOARD PLATFORM SUPPORT MECHANISM

(75) Inventor: Peter M. Barber, Fergus (CA)

(73) Assignee: CompX International Inc, Mauldin, SC (US)

( * ) Notice: Subject to any disclaimer, the term of this patent is extended or adjusted under 35 U.S.C. 154(b) by 0 days.

(21) Appl. No.: 09/467,697

(22) Filed: Dec. 21, 1999

Related U.S. Application Data

(60) Provisional application No. 60/159,660, filed on Oct. 15, 1999.

(51) Int. Cl.[7] ..... E04G 3/00

(52) U.S. Cl. ..... 248/284.1; 248/918

(58) Field of Search ..... 248/284.1, 286.1, 248/287.1, 291.1, 292.11, 298.1, 281.11, 288.51, 292.13, 631, 648, 280.11, 918

(56) References Cited

U.S. PATENT DOCUMENTS

| | | | | |
|---|---|---|---|---|
| 4,585,212 A | | 4/1986 | Yanker | 254/122 |
| 4,589,621 A | | 5/1986 | Hunt et al. | 248/586 |
| 4,616,798 A | | 10/1986 | Smeenge et al. | 248/281.1 |
| 4,632,349 A | | 12/1986 | Anstey | 248/281.1 |
| 4,706,919 A | * | 11/1987 | Soberalski et al. | 248/281.1 |
| 4,790,611 A | | 12/1988 | Craner | 312/306 |
| 4,826,123 A | | 5/1989 | Hannah et al. | 248/248 |
| 4,843,978 A | | 7/1989 | Schmidt et al. | 108/138 |
| 4,988,066 A | | 1/1991 | Cotterill | 248/281.1 |
| 5,037,054 A | | 8/1991 | McConnell | 248/284 |
| 5,145,136 A | | 9/1992 | McConnell | 248/284 |
| 5,257,767 A | | 11/1993 | McConnell | 248/284 |
| 5,823,487 A | * | 10/1998 | Kirchhoff et al. | 248/118 |
| 5,992,810 A | * | 11/1999 | Crinion et al. | 248/284.1 |
| 6,076,785 A | * | 6/2000 | Oddsen, Jr. | 248/118.3 |
| 6,116,557 A | * | 9/2000 | Choy et al. | 248/286.1 |

FOREIGN PATENT DOCUMENTS

| | | | |
|---|---|---|---|
| CH | NR99489 | 6/1923 | |
| CH | NR162103 | 8/1933 | |
| CH | 255365 | 1/1949 | |
| CH | 664549 | 10/1984 | B66F/3/00 |
| DE | 2535042 | 8/1975 | A47B/9/00 |
| DE | 3323780 | 7/1983 | A47B/27/04 |
| EP | 0017222 | 4/1980 | A47B/27/00 |
| EP | 0256610 | 3/1987 | A47B/17/02 |
| EP | 0341358 | 5/1988 | A61G/7/00 |
| EP | 0405234 | 6/1990 | A61B/6/00 |
| EP | 0322994 | 8/1992 | G01G/19/44 |
| EP | 0415176 | 5/1995 | A61B/6/00 |
| FR | 2517942 | 12/1982 | A47B/27/04 |

(List continued on next page.)

OTHER PUBLICATIONS

Industrial Design in Engineering, by Charles H. Flurscheim, 1983.

Industrial Design Magazine's 28th annual review, Published by Design Publications, 1982.

Design of a Three–Degree–of–Freedom Robotic Worktable With Prescribed Entire–Motion Characteristics, by Jau–Jung Chen, Sep. 1986.

*Primary Examiner*—Ramon O. Ramirez
*Assistant Examiner*—A. Joseph Wyciate
(74) *Attorney, Agent, or Firm*—Banner & Witcoff, Ltd.

(57) ABSTRACT

An improved brake and tilt adjustment control mechanism for a keyboard support platform includes a telescoping shaft connect between the keyboard platform and a housing supported on linkage arms that support the platform and connected the platform to a desk or support surface. The shaft is engaged by an encircling coil spring retained in the housing to lock the mechanism. Flexing the spring releases the locking mechanism and permits adjustment of the tilt or attitude of the keyboard platform relative to the linkage arms.

15 Claims, 5 Drawing Sheets

FOREIGN PATENT DOCUMENTS

| | | | |
|---|---|---|---|
| FR | 2547195 | 6/1983 | ..... A61G/13/00 |
| JP | 4732098 | 9/1972 | |
| JP | 48101256 | 12/1973 | |
| JP | 491361 | 1/1974 | |
| JP | 4910887 | 3/1974 | ..... A47B/1/02 |
| JP | 49337640 | 3/1974 | |
| JP | 4938753 | 4/1974 | |
| JP | 5017535 | 5/1975 | ..... A47C/3/20 |
| JP | 5190657 | 8/1976 | ..... A47C/17/26 |
| JP | 51148567 | 12/1976 | ..... A47C/1/00 |
| JP | 51151446 | 12/1976 | ..... F16M/13/00 |
| JP | 5230560 | 3/1977 | ..... A47C/21/08 |
| JP | 5393961 | 8/1978 | ..... A47C/1/00 |
| JP | 54127761 | 10/1979 | ..... A47C/1/032 |
| JP | 55119292 | 9/1980 | ..... F16M/11/00 |
| JP | 5769199 | 4/1982 | ..... F16M/11/00 |
| JP | 6044689 | 3/1985 | ..... F16M/11/20 |
| JP | 60146997 | 8/1985 | ..... F16M/11/38 |
| JP | 61136095 | 6/1986 | ..... F16M/11/00 |
| JP | 1250694 | 10/1989 | ..... F16M/11/38 |
| SE | 7308797 | 8/1976 | ..... A61G/13/00 |
| WO | WO8810081 | 12/1988 | ..... A47B/9/02 |

* cited by examiner 36
42
60
38
46
44
46
40
52
74
64
68
72
76
70
80
62
66
50
48
51
28
84
22
22

ADJUSTABLE COMPUTER KEYBOARD PLATFORM SUPPORT MECHANISM

This Application claims benefit of Provisional Application Ser. No. 60/159,660 filed Oct. 19, 1999.

BACKGROUND OF THE INVENTION

This invention relates a computer keyboard platform support mechanism and, more particularly, to the construction of the linkage arm assembly that connects the keyboard platform to a support surface. Specifically the invention relates to the combination of a braking mechanism with a linkage arm assembly that allows for adjustment of tilting of the keyboard support platform relative to the linkage arm assembly and the linkage arm assembly relative to the support surface or structure.

Various apparatus and mechanisms have been developed for supporting keyboards associated with computer terminals. One such apparatus is disclosed in Smeenge U.S. Pat. No. 4,616,798 entitled "Adjustable Support For CRT Keyboard." Smeenge teaches, inter alia, a keyboard support mechanism comprised of first and second sets of arms which link first and second brackets associated respectively with a keyboard platform and a sliding plate attached beneath a desk surface service. The Smeenge patent is incorporated here by reference. Subsequent patents relating to the same subject matter include: U.S. Pat. 5,037,054 entitled "Adjustable Support Mechanism For A Keyboard Platform," issued Aug. 6, 1991 also incorporated herewith by reference.

The mechanisms disclosed in these prior patents are quite useful for supporting a keyboard on a platform adjacent to a work surface and for permitting upward and downward adjustment of that keyboard platform as well as lateral or side to side adjustment and tilt of the keyboard platform. When adjusting the elevation and attitude or tilt of such keyboard platforms, it is desirable to have a braking mechanism which maintains the keyboard platform in a fixed position by locking the arms, but which may be easily released to permit desired readjustment of the position of the platform. It is further desirable to have all of the adjustments independent, one from the other. It is also desirable to have a keyboard platform support mechanism which is compact, easily stored, of simple construction, yet rugged enough to support a significant weight. It is also desirable to have a construction which will fold away quite easily and can be easily moved from one position to another. These, among other objectives, provided an incentive for development of the present construction.

SUMMARY OF THE INVENTION

In a principal aspect, the present invention comprises a keyboard platform support mechanism which includes a keyboard support platform pivotally attached to linkage arms which, in turn, are pivotally attached to a bracket connected to a support surface. Thus, the first and second linkage arms are typically pivotally connected at their outer ends to a keyboard support platform and at their inner end to the support surface bracket. The linkage arms thus permit pivotal motion of the keyboard platform about a horizontal axis defining the connection between the linkage arms and the keyboard support platform as well pivotal motion about a horizontal axis defining the connection between the support surface bracket and the linkage arms.

As an important feature of the invention, a braking mechanism is provided for each of the horizontal pivot connections defined at the opposite ends of the linkage arms.

Thus in one embodiment, a slide rod member is pivotally attached to the keyboard support platform. That slide rod member is telescopically fitted through a housing which is pivotally attached to a linkage arm. A gripping element is integrated into the housing to engage or grip the slide rod member and retain the slide member in a fixed position within the housing, thereby precluding further pivotal movement of the keyboard support platform relative to the linkage arm. The gripping element is, however, releasable and may disengage from the slide member, thereby permitting the slide member to assume a distinct or different telescopic position associated with pivoting or tilting of the keyboard support platform about a horizontal axis. The gripping element in its preferred embodiment, automatically returns to a gripping position upon release of a manual force that effects disengagement of the gripping element from the slide member. In a preferred embodiment, a brake mechanism of the type described is incorporated to control each pivotal horizontal axis connection of the linkage arms, or, in other words, the described braking mechanism is provided at each of the opposite ends of the linkage arm. Thus, a braking mechanism is included in association with the horizontal axis pivotal connection of the keyboard support platform to the linkage arms and is also provided with respect to the horizontal pivotal axis connection associated with the opposite ends of the linkage arms which effect attachment to a support surface, such as a desk, or the like.

Thus, it is an object of the invention to provide an improved keyboard support mechanism which is easily adjustable and which includes a releasable brake mechanism.

Yet a further object of the invention is to provide an improved brake engagement and brake release mechanism associated with a keyboard support platform.

Yet another object of the invention is to provide a rugged, yet adjustable keyboard support platform mechanism wherein the keyboard platform is independently adjustable relative to the adjustment associated with a linkage arm supporting the platform on or by a support surface.

These and other objects, advantages and features of the invention will be set forth in a detailed description which follows:

BRIEF DESCRIPTION OF THE DRAWING

In the detailed description which follows, reference will be made to the drawing comprised of the following figures.

DESCRIPTION OF THE PREFERRED EMBODIMENT

Figure 1:
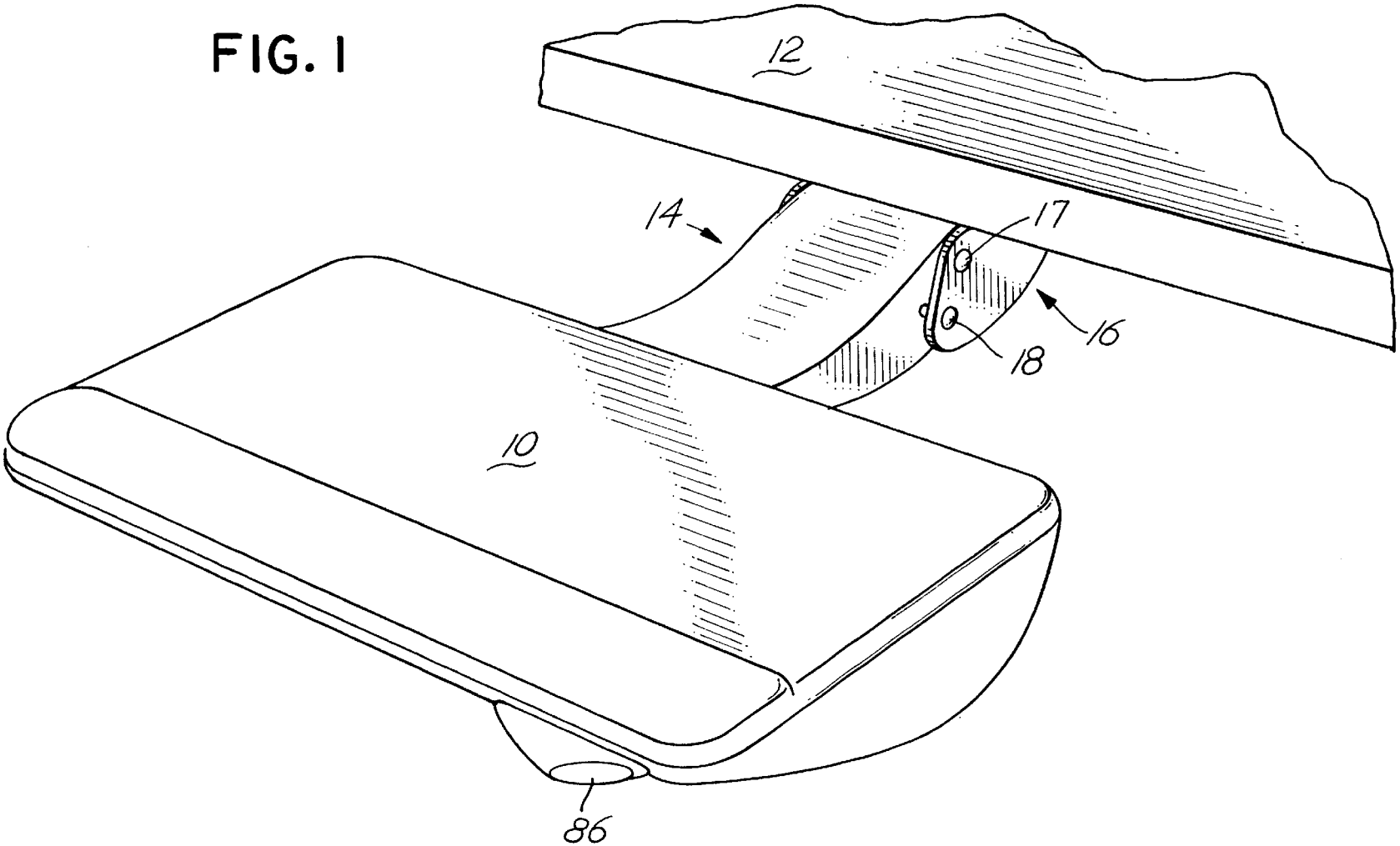
FIG. 1 is an isometric view of a typical computer support platform incorporating the mechanism of the invention.
Figure 2:
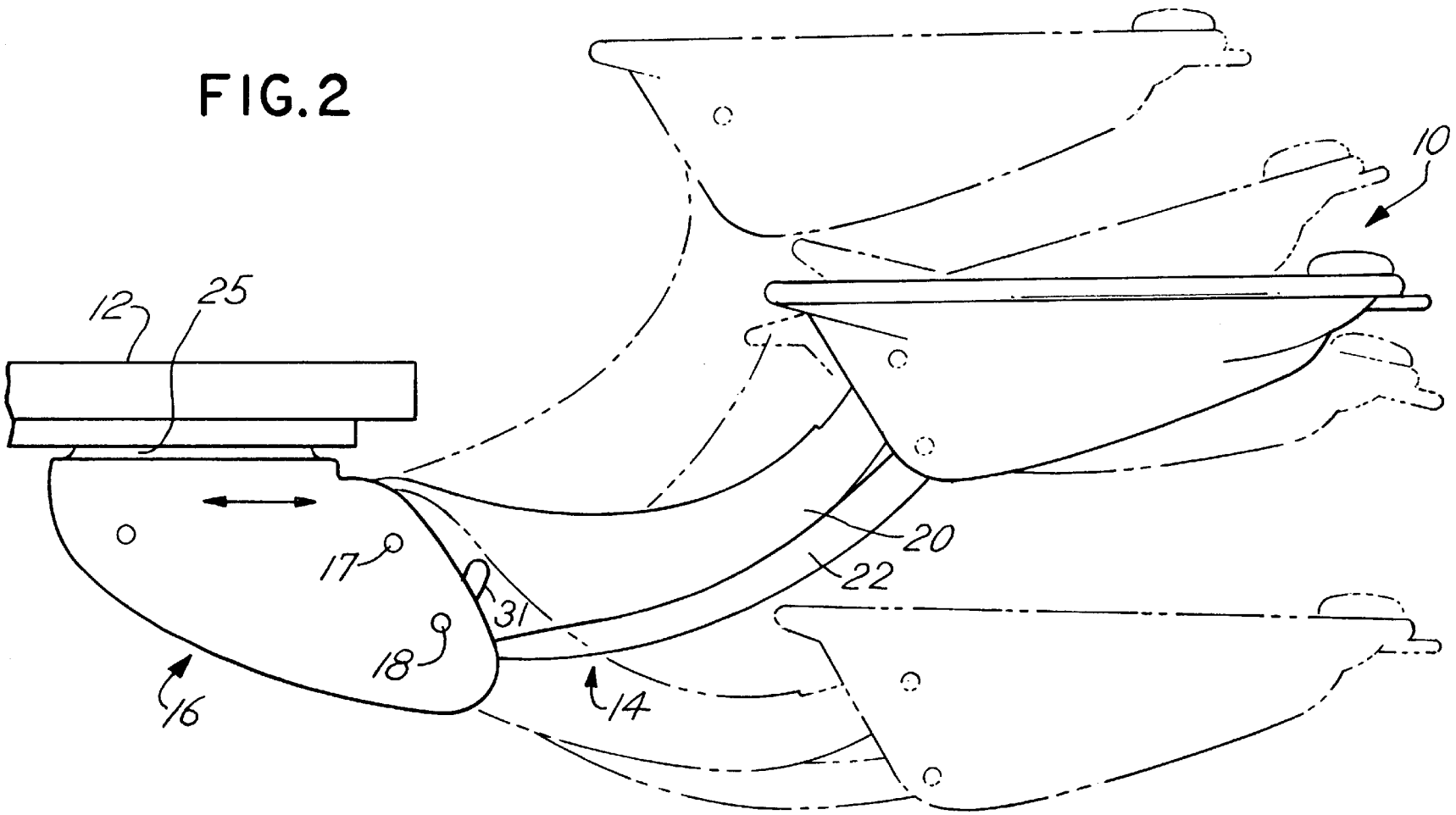
FIG. 2 is a side elevation of the support platform of FIG. 1.
Figure 3:
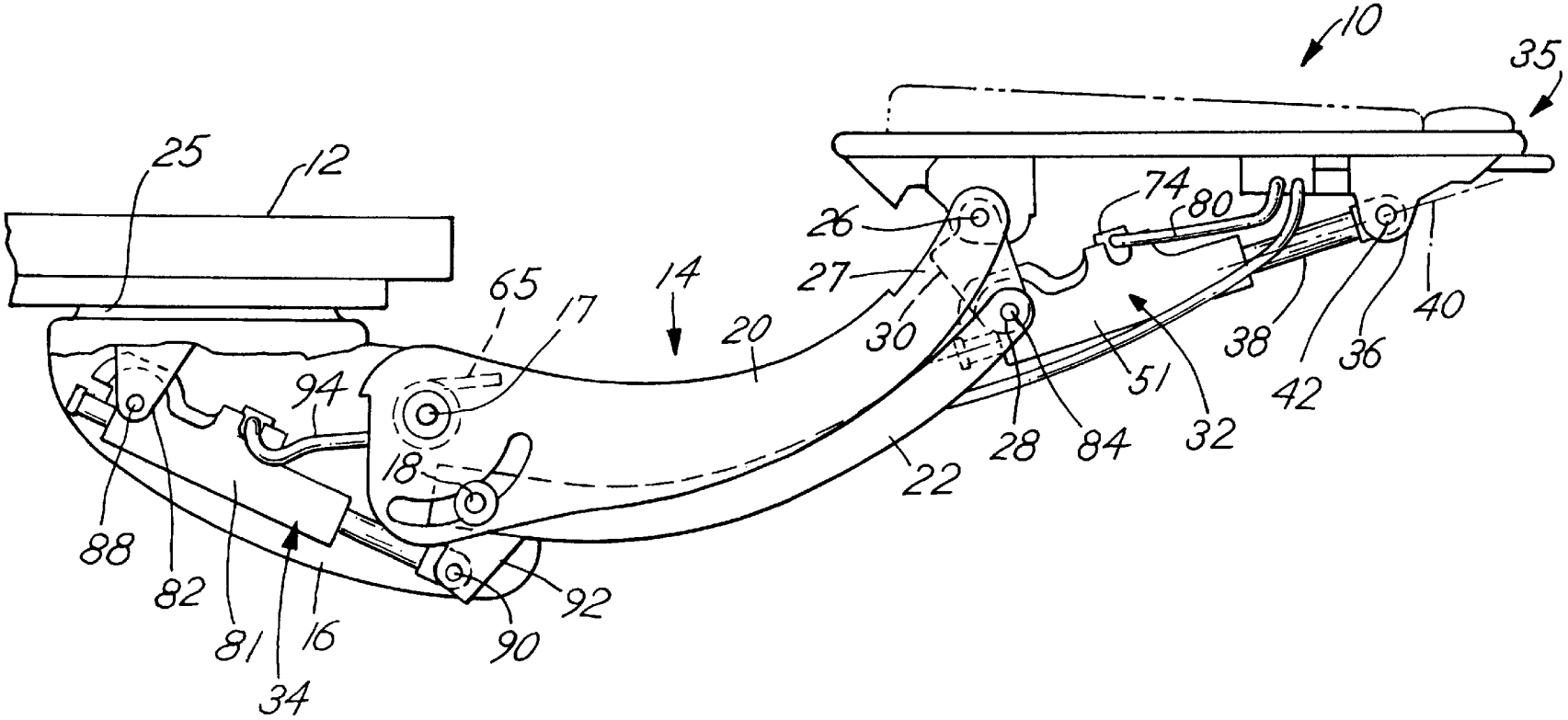
FIG. 3 is an enlarged cut-away side view of the construction shown in FIG. 2.

FIGS. 1 through 3 illustrate the overall construction of a computer keyboard platform support arm mechanism incorporating the invention. However, the invention is not limited to the particular keyboard arm platform support mechanism depicted.

The mechanism includes a generally planer keyboard support platform 10 which is connected to a support surface 12 such as a desk by means of a linkage arm assembly 14. The linkage arm assembly 14 typically is attached to the underside of the desk or support surface 12 by means including a depending bracket 16. The bracket 16 may be pivotally attached by pivot connection 25 to the underside of the surface 12 or rigidly or slidably attached thereto.

In the embodiment depicted, the linkage arm assembly 14 is a modified quadrilateral-type connection mechanism comprised of a first or top linkage arm 20 and a second, or bottom linkage arm 22. The top arm 20 connects to bracket 16 via a horizontal rod 17 which defines a horizontal pivot axis. The opposite end 27 of the top linkage arm 20 connects to a keyboard platform bracket 30 via a shaft or rod 26 which also defines a horizontal pivot axis. The bottom linkage arm 22 is connected at its opposite ends to bracket 16 and bracket 30. However, the connection in one instance is a variable or movable axis connection and incorporates a brake and release mechanism. Thus bracket 16 and bottom arm 22 are effectively connected by a horizontal rod or shaft 18 which defines a horizontal axis which is slidable in an accurate slot 31 in bracket 16.

The bottom arm 22 is connected effectively to bracket 30 associated with and depending from keyboard platform 10 by shaft or rod 28 which also defines a horizontal axis. The pivot rods 26, 28 and thus the linkage arms 20, 22 are linked by a spacing bracket or link 30. Thus, the arms 20, 22 in combination with pivot rods 26, 28, 17, 18 define a quadrilateral connection between platform 10 and support surface 12 modified as described below. Bracket 30 may also pivot about rod 26 to thereby permit adjustment of tilt of the bracket 30 and thus attitude of platform 10 as described below. The use of pairs of linkage arms 20, 22 in a quadrilateral array provides for controlled movement of platform 10 as it is raised and lowered. A biasing spring 65 on shaft 17 may be arranged to bias the arms 20, 22 upwardly.

An adjustable length connection or link and brake mechanism 32 between a bracket 36 at the forward end 35 of platform 10 and pivot rod 28 of bottom arm 22 may be manipulated to release or lock platform 10 at a desired tilt. Thus, when brake mechanism 32 is released, the relative tilt of platform 10 may be adjusted as the arms 20, 22 are both moved and pivoted about the horizontal axes to raise and lower the platform 10. A similar adjustable length connection and braking mechanism 34 is included between the bracket 16 and lower arm 22 as described below.

The improvement of the invention relates to the combination and incorporation of the brake mechanism 32 associated with the platform 10 and the lower arm 22 as well as the adjustable length link and brake mechanism 34 associated with the connection of arm 22 to bracket 16. The link and brake mechanism 32 operates substantially in the same manner as the second link and brake mechanism 34 associated with the support platform bracket 16 and the linkage arm 22. A description of the construction and operation of the mechanism 32 will thus be generally applicable to the mechanism 34.

Figure 5:
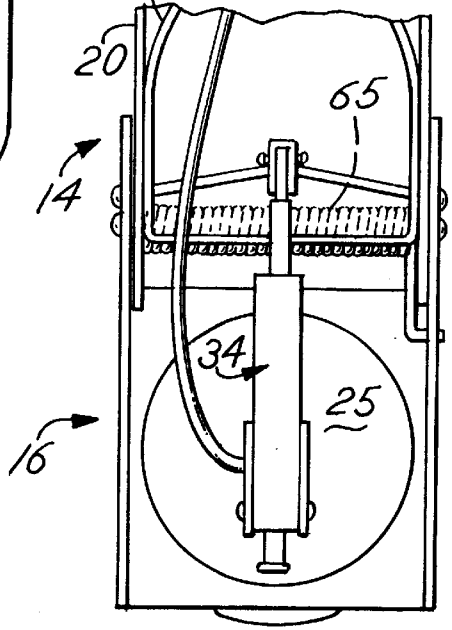
FIG. 5 is a bottom plan view of the braking mechanism associated with the connection of the linkage arm to the keyboard platform.
Figure 4:
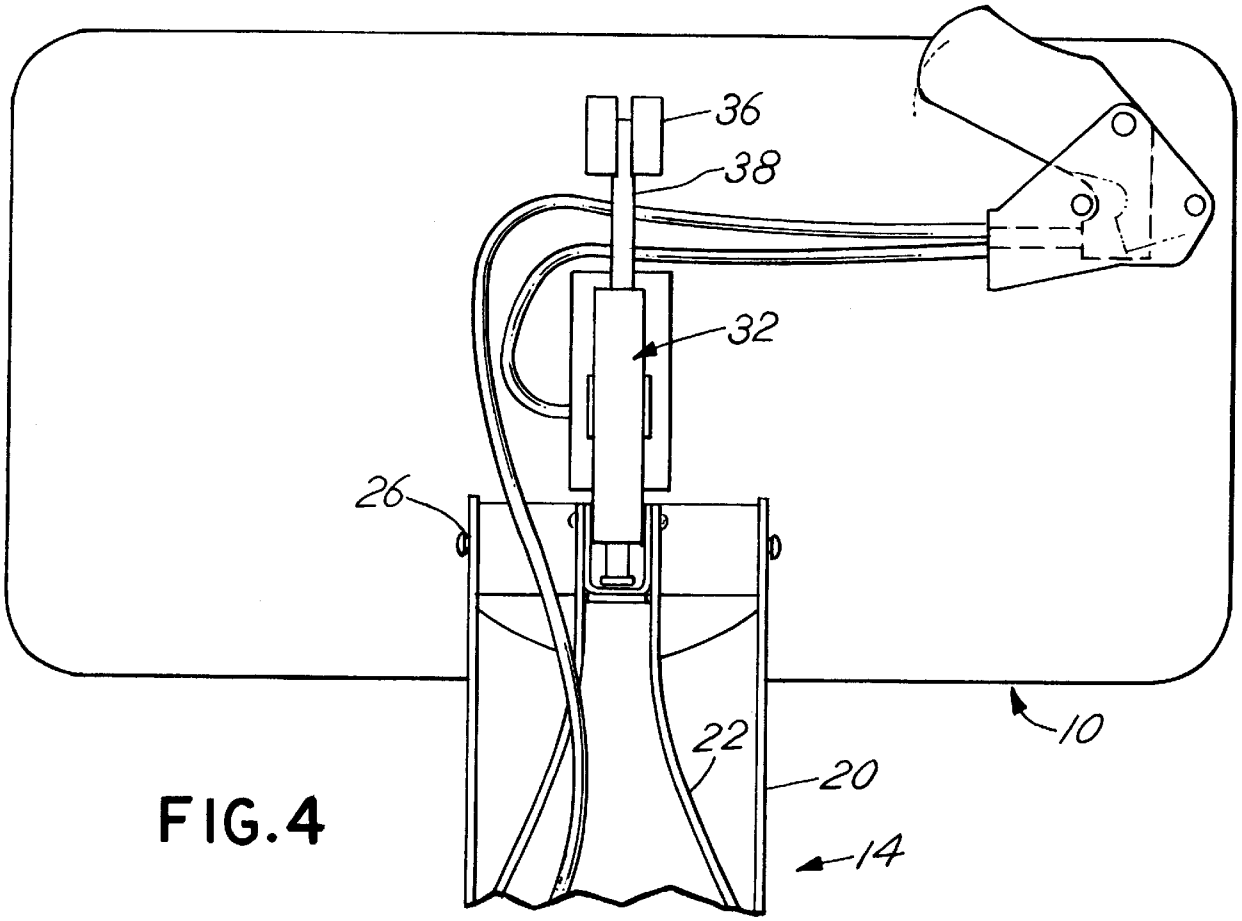
FIG. 4 is a bottom plan view depicting the braking mechanism depicted in FIG. 3.
Figure 6:
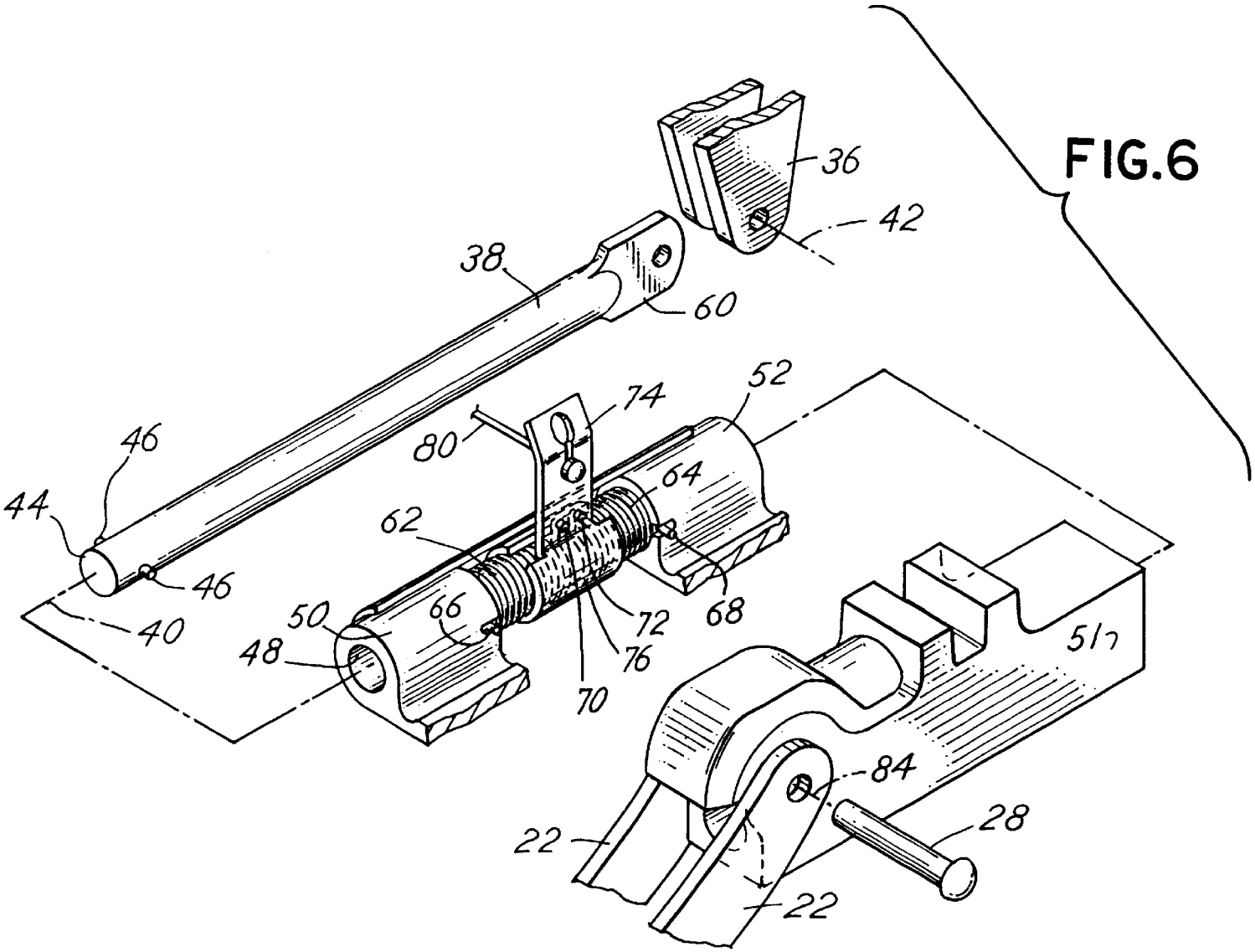
FIG. 6 is an exploded isometric view of elements of the braking mechanism of the type depicted in FIGS. 4 and 5.

FIG. 6 depicts the link and brake mechanism 32 in an exploded view and FIGS. 4 and 5 depict the mechanisms 32, 34 incorporated in the embodiment of the invention. Specifically, FIG. 4 depicts the brake mechanism 32 incorporated in combination with the support platform 10 and linkage arms 20, 22. FIG. 5 depicts the brake mechanism 34 as incorporated in the connection between the linkage arm 22 and the bracket 16 which is associated with the underside of platform 12.

Referring to these figures, and also FIG. 6, the platform 10 includes a depending support bracket 36 fixed to the underside thereof. An elongated, generally cylindrical shaft or rod 38 defining an axis 40 is pivotally attached to the bracket 36 at a pivot connection 42. The rod or shaft 38 is elongated and generally cylindrical. The free distal end 44 of the shaft 38 includes projecting lugs 46 which serve to retain the shaft 38 in a housing 51 and limit sliding movement as described below.

The shaft 38 thus fits through spaced, cylindrical passages 48 defined in spaced housing sections 50, 52 mounted in housing 51. The shaft 38 is retained within the housing 51 for sliding movement between the extremes defined by a flange 60 and the lugs 46. The shaft 38 is telescopically inserted through the passages or openings 48 as described.

Encircling the shaft 38 in the space between the housing sections 50, 52, are first and second coil springs 62, 64. The coil springs 62, 64 each have a first end 66, 68, respectively, which are retained by and engaged by the housings 50, 52, respectively. The opposite ends of the coil springs 62, 64, namely, ends 70, 72, respectively, are connected to a bracket arm 74 which includes an encircling, cylindrical section 76 that fits over the coil springs 62, 64 in order to keep all of the component parts properly aligned and retained about the shaft or rod 38. The arm 74 may be rotated about the axis 40 by movement in the direction indicated by the arrow in FIG. 6. Such movement causes the coil springs 62, 64 to be partially uncoiled and release their grip on the shaft 36. The coil springs 62, 64 in their normal configuration will be biased in a counter-clockwise direction as depicted in FIG. 6, so as to engage tightly around the shaft 38 precluding the shaft from axial movement and, in fact, further precluding the shaft from any rotary or axial movement and release from shaft 38. The tension associated with the coil springs 62, 64 engaging the shaft 38 is altered by rotating the bracket arm 74 in the clockwise direction in FIG. 6. Such rotation is effected by means of a control wire or rod 80. Such rotation and release of the force of the springs 62, 64 from the shaft or rod 38 will thus permit the rod 38 to be adjusted telescopically within the housing 51. The housing bracket 51 connects pivotally about a pivot axis 84 to the linkage arm 22, the connection being effected by the shaft or rod 28. Thus, the housing 51 may pivot as necessary in order to accommodate telescopic movement of shaft 38 within the housing sections 50, 52.

In order to adjust the attitude of the platform 10 relative to the linkage arms 20, 22, the bracket arm 74 is engaged by the rod or wire 80 and moved in the clockwise direction in FIG. 6. This releases the grip of springs 62, 64 on shaft 38. The platform 10 may then be pivoted as the shaft 38 moves within the housing, 52. The pivoting is effected about the axis of rod 28. The attitude of the platform 10 is thereby altered or changed in a desired fashion. The control wire or rod 80 is connected to a control button 86 on the platform 10.

The brake mechanism 34 is substantially identical in construction and function to the brake mechanism 32. That is, the brake mechanism 34 includes a telescoping shaft or rod 38 which fits within a housing 51 mounted on a bracket assembly 82 which is pivotally attached to the bracket 16 by means of a pivot connection 88. The shaft 38 is connected to the linkage arm 22 by a pivot connection 90 and bracket member 92. A control wire 94 is provided to drive or manipulate a bracket on 74 of the brake mechanism 34. The wire or rod 94 again may be connected to operate in unison with the wire rod 80 by being connected to control member or button 86. The brake mechanism 34 adjusts the attitude of the linkage members 20, 22 relative to the surface 12 and effects a locking or a release of the locking arrangement as described.

If both brake mechanisms 32, 34 are released simultaneously merely by operating the button 86, the total attitude and orientation of the keyboard support platform 10 may be adjusted. However, in another embodiment, the brake mechanisms 32 and 34 may be independently adjustable. Further, two linkage arms 20, 22 may not be required. That is a single linkage arm 20 in combination with braking mechanisms 32, 34 may be utilized. The assembly may also include merely one of the braking mechanisms 32 and/or 34 in combination with other types of braking mechanisms. Thus, the subject matter of the invention is susceptible of many combinations and permutations. The invention is, therefore, to be limited only by the following claims and equivalents thereof.

What is claimed is:

1. A keyboard platform support mechanism comprising, in combination:

(a) a platform;

(b) a first linkage arm pivotally connected to the platform;

(c) an assembly for attaching the linkage arm to a surface;

(d) a brake mechanism connecting the first linkage arm to the platform, said brake mechanism including a slide member connected to one of the platform and the first linkage arm and having an opposite end, said brake mechanism further including a housing connected to the other of the platform and linkage arm and slidably receiving the slide member, said slide member slidable in the housing, said housing including a gripping element surrounding, at least in part, the slide member, said gripping element including a projecting arm for movement of the gripping element between a first position where in the slide member is engaged by the gripping element and prevented from axial movement and a second position wherein the slide member is released for movement to alter the length of the connection effected by the brake mechanism between the linkage arm and platform whereby upon such movement the platform is pivotal about its connection to the first linkage arm.

2. The combination of claim 1 wherein the platform is a keyboard platform.

3. The combination of claim 1 wherein the platform is a support platform.

4. The combination of claim 1 in further combination with a separate brake mechanism connecting each end of the linkage arm to a pivotally connected platform attached to the linkage arm.

5. The combination of claim 1 wherein the slide member is a cylindrical rod pivotally attached at one end.

6. The combination of claim 1 wherein the brake mechanism housing comprises a through passage for telescopically receiving the slide member.

7. The combination of claim 1 wherein the gripping element comprises a coil spring having fitted over the slide member.

8. The combination of claim 1 wherein the projecting arm projects radially from the axis of the slide member.

9. A keyboard platform support mechanism comprising, in combination:

(a) a platform;

(b) a first linkage arm pivotally connected to the platform;

(c) an assembly for attaching the linkage arm to a surface;

(d) a brake mechanism connecting the first linkage arm to the platform, said brake mechanism having a housing and including a slide member, the housing slidably receiving the slide member, the housing connected to one of the platform and the first linkage arm, the slide member connected to the other of the platform and the first linkage arm, the housing further including a gripping element surrounding, at least in part, the slide member, the brake mechanism further including a projecting arm connected to the gripping element, whereby movement of the projecting arm provides movement of the gripping element between a first position where the slide member is engaged by the gripping element and prevented from axial movement, and a second position where the slide member is released to permit movement of the slide member.

10. The combination of claim 9 wherein the platform is a keyboard platform.

11. The combination of claim 9 wherein the platform is a support platform.

12. The combination of claim 9 in further combination with a separate brake mechanism connecting each end of the linkage arm to a pivotally connected platform attached to the linkage arm.

13. The combination of claim 9 wherein the slide member is a cylindrical rod pivotally attached at one end.

14. The combination of claim 9 wherein the brake mechanism housing comprises a through passage for telescopically receiving the slide member.

15. The combination of claim 9 wherein the gripping element comprises a coil spring that is fitted over the slide member.

* * * * *